US005351769A

United States Patent [19]

Scott et al.

[11] Patent Number: 5,351,769

[45] Date of Patent: Oct. 4, 1994

[54] EARTH-BORING BIT HAVING AN IMPROVED HARD-FACED TOOTH STRUCTURE

[75] Inventors: Danny E. Scott, Houston; Anton F. Zahradnik, Sugarland; Rudolf C. O. Pessier, Houston, all of Tex.

[73] Assignee: Baker Hughes Incorporated, Houston, Tex.

[21] Appl. No.: 76,029

[22] Filed: Jun. 14, 1993

[51] Int. Cl.[5] ..... E21B 10/16

[52] U.S. Cl. ..... 175/374; 175/425

[58] Field of Search ..... 175/374, 425, 435, 426, 175/430, 431, 432

[56] References Cited

U.S. PATENT DOCUMENTS

| | | | |
|---|---|---|---|
| 2,033,594 | 3/1936 | Stoody | 262/33 |
| 2,058,753 | 10/1936 | Zublin | 76/108 |
| 2,407,642 | 9/1946 | Ashworth | 76/108 |
| 2,660,405 | 11/1953 | Scott et al. | 255/347 |
| 2,911,196 | 11/1959 | Cameron et al. | 255/301 |
| 3,442,342 | 5/1969 | McElya et al. | 175/374 |
| 4,365,679 | 12/1982 | van Nederveen et al. | 175/371 |
| 4,455,278 | 6/1984 | van Nederveen et al. | 419/6 |
| 4,630,692 | 12/1986 | Ecer | 175/330 |
| 4,726,432 | 2/1988 | Scott et al. | 175/375 |
| 4,751,972 | 6/1988 | Jones et al. | 175/329 |
| 4,781,770 | 11/1988 | Kar | 148/16.5 |
| 4,836,307 | 6/1989 | Keshavan et al. | 175/374 |
| 4,969,378 | 11/1990 | Lu et al. | 76/108 |
| 5,051,112 | 9/1991 | Keshavan et al. | 51/309 |
| 5,131,480 | 7/1992 | Lockstedt et al. | 175/374 |
| 5,152,194 | 10/1992 | Keshavan et al. | 76/108.2 |

*Primary Examiner*—William P. Neuder

*Attorney, Agent, or Firm*—Robert A. Felsman; Mark D. Perdue

[57] ABSTRACT

An earth-boring bit has a bit body and at least one cutter rotatably secured to the bit body. The cutter has a plurality of teeth formed integrally thereon and arranged in circumferential rows. Each of the teeth includes an inner end, an outer end, a pair of flanks and a crest substantially transversely connecting the ends and flanks. The crests of the at least one of the plurality of teeth has a depression formed therein that extends from the outer end of the tooth to an intermediate point along the crest, a remainder of the crest defines a raised crest portion. A wear-resistant material is applied over at least the crest and a portion of at least the ends and flanks of the at least one of the plurality of teeth, wherein the thickness of the wear-resistant material over the depression is substantially greater than elsewhere on the tooth.

10 Claims, 2 Drawing Sheets

EARTH-BORING BIT HAVING AN IMPROVED HARD-FACED TOOTH STRUCTURE

BACKGROUND OF THE INVENTION

1. Field of the Invention

The present invention relates generally to the tooth structure of earth-boring bits of the rolling cutter variety. More particularly, the present invention relates to improving the wear-resistance of mill- or steel-tooth earth-boring bits.

2. Background Information

The success of rotary drilling enabled the discovery of deep oil and gas reservoirs. The rotary rock bit was an important invention that made that success possible. Only soft formations could be commercially penetrated with the earlier drag bit, but the original rolling-cone rock bit invented by Howard R. Hughes, U.S. Pat. No. 939,759, drilled the hard caprock at the Spindletop Field, near Beaumont, Tex., with relative ease.

That venerable invention, within the first decade of this century, could drill a scant fraction of the depth and speed of the modern rotary rock bit. If the original Hughes bit drilled for hours, the modern bit drills for days. Bits today often drill for miles. Many individual improvements have contributed to the impressive overall improvement in the performance of rock bits.

The early rolling-cone earth-boring bits had teeth formed integrally with the cutters. These bits, commonly known as "steel-tooth" or "mill-tooth" bits, are still in common usage for penetrating relatively soft formations. The strength and fracture-toughness of the steel teeth permits relatively long teeth with long crests, which provide the aggressive gouging and scraping action that is advantageous for the rapid penetration of relatively soft formations.

However, it is rare that a formation interval will consist entirely of soft material with low compressive strength. Often, there are streaks of hard or abrasive materials that a steel-tooth bit must be able to penetrate economically, without damage to the bit.

Although steel teeth possess good strength, their abrasion resistance generally is not adequate to permit rapid penetration of hard or abrasive streaks without damage to the bit. Consequently, it is conventional in the art to provide a layer of wear-resistant material or hard-facing over at least a portion of the teeth of a steel tooth bit. These wear-resistant materials or hard-facings are conventional, and typically consist of particles of tungsten carbide or other hard metal dispersed in a steel or cobalt binder matrix. Such hard-facing materials are applied by melting the binder of the hard-facing material and applying the material over the surfaces of the tooth. The proper application of hard-facing material to steel tooth bits requires considerable skill on the part of the welder.

Internal records at Hughes Christensen Company indicate that the practice of hard-facing steel teeth was initiated in approximately 1929. With the introduction of the tungsten carbide insert (TCI) bit by Hughes Tool Company in the 1950's (see U.S. Pat. No. 2,687,875, Aug. 31, 1954, to Morlan, et al.), the focus of the drilling industry turned to the use of TCI bits. More recently, however, attention again has focused on the improvement and development of earth-boring bits of the mill- or steel-tooth variety because of advances in bearing and seal technology.

It is difficult to apply a relatively thick layer of hard-facing material over the crest or ends of teeth within tolerance.

A tooth with a crest hard-faced to a thickness beyond the tolerance can cause the tooth to interfere with or "strike" an opposing cone. This condition requires expensive and time-consuming grinding of the hard-faced crest to reduce the thickness and eliminate interference. At least as early as 1989, one corner of the steel teeth in one row is beveled to permit application of hard-facing without causing the aforementioned interference between teeth.

U.S. Pat. No. 5,152,194, Oct. 6, 1992, to Keshavan, et al. discloses a method of hard-facing a steel-tooth earth-boring bit, wherein a substantially uniform thickness of hard-facing is provided over the tooth. Each corner of each tooth is rounded to achieve uniform hard-facing thickness. That disclosure does not address the difficulty of applying a thick layer of hard-facing material over a tooth of a steel-tooth earth-boring bit without incurring the problem of tooth strike, which requires costly and time-consuming grinding operations to bring the hard-faced tooth within the clearances and tolerances necessary to avoid strike.

A need exists, therefore, for an earth-boring bit having hard-faced steel tooth structure that permits and facilitates application of hard-facing material in substantial thicknesses over the tooth, while avoiding over-application of hard-facing material.

SUMMARY OF THE INVENTION

It is a general object of the present invention to provide an improved earth-boring bit having an improved hard-faced tooth structure.

This and other objects of the present invention are achieved by providing an earth-boring bit having a bit body and at least one cutter rotatably secured to the bit body. The cutter has a plurality of teeth formed integrally thereon and arranged in circumferential rows. Each of the teeth includes an inner end, an outer end, a pair of flanks and a crest substantially transversely connecting the ends and flanks. The crest of the at least one of the plurality of teeth has a depression formed therein that extends from the outer end of the tooth to an intermediate point along the crest, a remainder of the crest defines a guide rib portion. A wear-resistant material is applied over at least the crest and a portion of at least the ends and flanks of the at least one of the plurality of teeth, wherein the thickness of the wear-resistant material over the depression is substantially greater than elsewhere on the tooth.

The guide rib portion facilitates application of the wear-resistant material over the tooth crest. According to a preferred embodiment of the present invention, the earth-boring bit has three cutters, each of the cutters having a plurality of teeth formed integrally thereon. Each of the crests of the plurality of teeth is provided with the depression and raised crest portion.

Other objects, features, and advantages of the present invention will become apparent to those having skill in the art with reference to the drawings and detailed description, which follow.

DESCRIPTION OF THE PREFERRED EMBODIMENT

Figure 1:
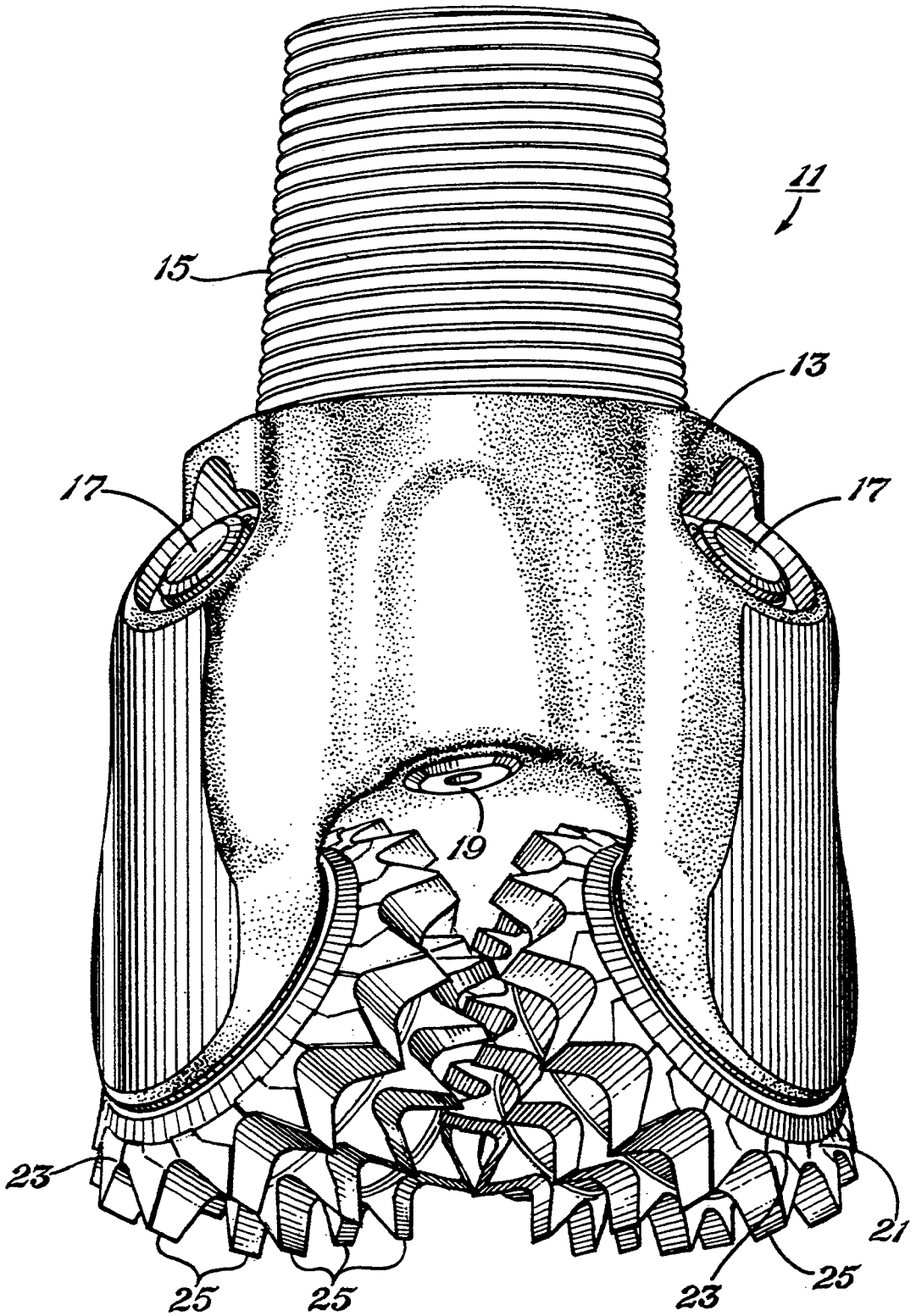
FIG. 1 is a perspective view of an earth-boring bit of the type contemplated by the present invention.

Referring now to FIG. 1, an earth-boring bit 11 according to the present invention is depicted. Earth-boring bit 11 includes a bit body 13 having threads 15 at its upper extent for connecting bit 11 into a drillstring (not shown). Each leg of bit 11 is provided with a lubricant compensator 17, a preferred embodiment of which is disclosed in U.S. Pat. No. 4,276,946, Jul. 7, 1981, to Millsapps. At least one nozzle 19 is provided in bit body 13 for spraying cooling and lubricating drilling fluid from within the drillstring to the bottom of the borehole.

At least one cutter, in this case three (one of which is obscured from view in the perspective of FIG. 1), 21, 23 is rotatably secured to each leg of bit body 13. A plurality of teeth 25 are arranged in generally circumferential rows on cutters 21, 23. Teeth 25 are integrally formed from the material of cutters 21, 23, which is usually steel.

Figure 2:
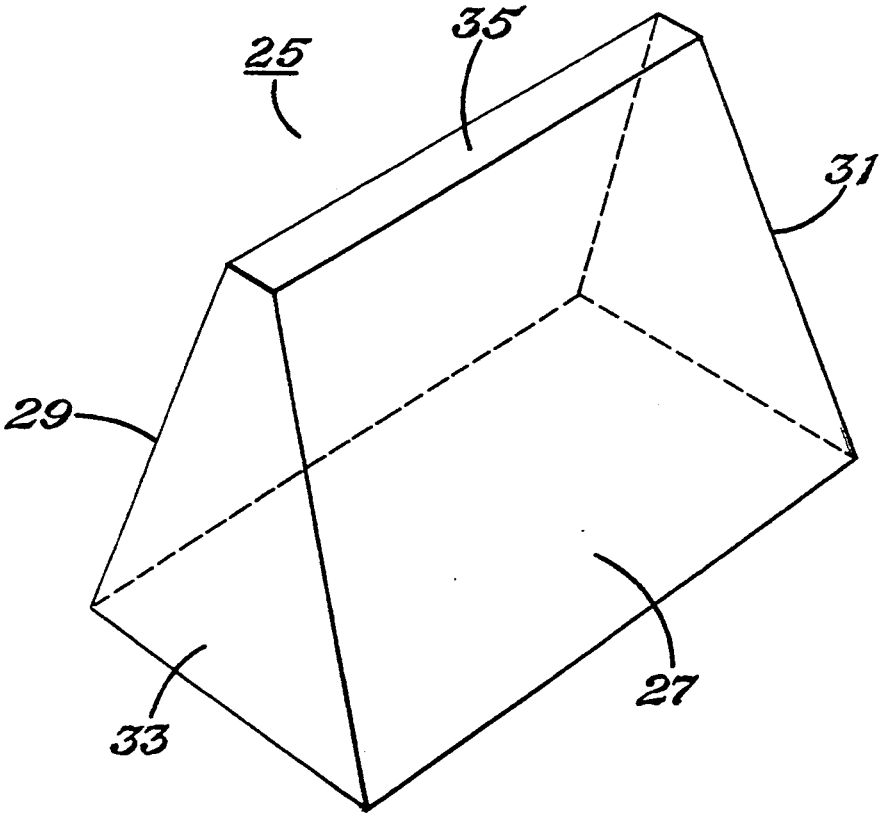
FIG. 2 is a schematic representation of a steel tooth, which depicts the various surfaces of such a tooth.
Figure 3:
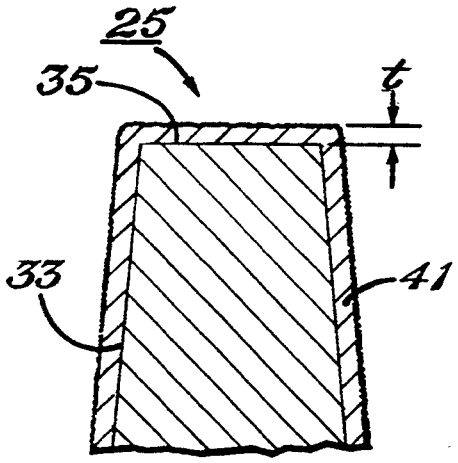
Fig.3 PRIOR ART
FIG. 3 is a fragmentary section view of a prior-art hard-faced steel tooth.

FIGS. 2 and 3 illustrate a prior-art hard-faced steel or milled tooth 25. FIG. 2 schematically represents tooth 25 to illustrate its various surfaces, and FIG. 3 is a fragmentary section view of a hard-faced tooth 25 similar to that schematically represented in FIG. 2. Tooth 25 has a number of surfaces, including a pair of flanks 27, 29, an inner end 31, an outer end 33, and a crest 35 substantially transversely connecting flanks 27, 29 and ends 31, 33. Inner end 31, and outer end 33 are named with reference to the center line of earth-boring bit 11. Inner end 31 is so named because it is nearer the center line of bit 11, and outer end 33 is so named because it is more distant from the center line, and thus nearer the outer periphery of bit 11. A layer 41 of wear-resistant material, commonly known as hard-facing, is provided over flanks 27, 29, ends 31, 33 and crest 35. Hard-facing layer 41 is provided to increase the hardness and wear-resistance of tooth 25. Hard-facing materials are conventional in the art and generally consist of particles of tungsten carbide or other hard metal dispersed in a binder matrix of cobalt, steel, or an alloy thereof. Hard-facing materials generally are applied by melting the binder and applying the hard-facing over tooth 25 using a gas torch. Considerable welding skill is required to obtain a relatively even layer 41 that covers all of the tooth surfaces that are desired to be hard-faced.

One limitation on the thickness t of hard-facing layer 41 is the clearance or tolerance necessary to avoid striking or interference between teeth 25 and opposing cutters 21, 23. Thus, a welder must strike a careful balance between applying a hard-facing layer 41 that is sufficiently thick to effectively increase the wear-resistance of tooth 25, while insuring that tooth 25 remains within tolerance and does not strike an opposing cutter 21, 23. If thickness t of hard-facing layer 41 is so great that it causes striking or interference, costly grinding operations are necessary to bring tooth 25 back into tolerance necessary to avoid striking. If thickness t is insufficient, the resulting performance of bit 11 may be less than expected. A conventional thickness t of hard-facing layer 41 is approximately 0.062 or 1/16 inch.

Figure 4:
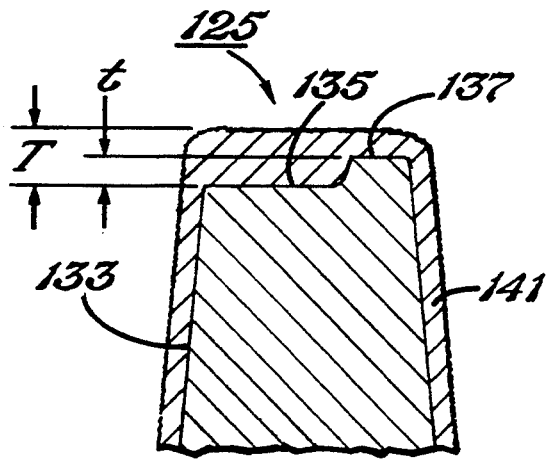
FIG. 4 is a fragmentary section view of the hard-faced steel tooth structure according to the present invention.

FIG. 4 illustrates, in fragmentary section view, a hard-faced tooth 125 according to the present invention. Like tooth 25 illustrated in FIG. 2 and 3, tooth 125 according to the present invention includes an inner end 131 and an outer end 133, as well as a pair of flanks (not shown in FIG. 4). Tooth 125 according to the present invention is provided with a stepped crest comprising a substantially planar depression 135 and a guide rib portion 137. Depression 135 extends from outer end 133 to an intermediate point along the crest, the remainder of the crest defining a guide rib portion 137.

A layer of hard-facing 141 is provided over tooth 125, preferably covering at least stepped crest 135,137 and a portion of ends 131, 133 and the flanks.

Planar depression 135 of the stepped crest provides the ability to obtain a greater thickness T of hard-facing layer 141 over the portion of the stepped crest nearest outer end 133 of tooth 125. This permits a more wear-resistant crest at outer end 133 of tooth 125, which is believed to be most susceptible to abrasive wear.

Moreover, the combination of planar depression 135 and guide rib portion 137 provides a guide for the welder to apply a sufficiently thick hard-facing layer 141 while avoiding application of a hard-facing layer that is too thick or too thin, leading to striking of teeth 125 and cutters 21, 23 or premature wear. A welder first applies a bead of hard-facing sufficient to fill depression 135 to a level even with guide rib portion 137, and then applies a standard thickness t of hard-facing material over at least the crest and a portion of the remainder of tooth 125.

Preferably, depression 135 has a depth, relative to guide rib portion 137, equal to or greater than the thickness t of a conventional hard-facing layer (41 in FIG. 3). Thus, when hard-facing operations are complete, the thickness T of hard-facing layer 141 over depression 135 is substantially twice that of conventional hard-facing over the remainder of tooth 125.

Thus, according to the preferred embodiment of the present invention, thickness T of hard facing layer 141 is substantially 0.125 or ⅛ inch. According to the preferred embodiment of the invention, all of teeth of bit 11 that conventionally are hard-faced are provided with the stepped crest 135, 137.

With references to FIGS. 1–4, the operation of earth-boring bit 11 according to the present invention will be described. Bit 11 is connected by threads 15 into a drillstring (not shown). Drillstring and bit 11 then are rotated, wherein cutters 21, 23 roll and slide over the bottom of the borehole. As cutters 21, 23 roll and slide over the bottom of the borehole, teeth 25 gouge and scrape formation material, resulting in penetration of the formation. Drilling fluid from within drillstring exits nozzle 19, cooling and lubricating cutters 21, 23, and lifting fragments of formation material away from the bottom of the borehole.

Improved hard-faced teeth 125 remain sharp because of their improved wear-resistance which, results from increased thickness T of hardfacing layer 141 over selected portions of tooth 125.

A principal advantage of the present invention is the provision of an earth-boring bit having improved wear-resistance. The improved tooth structure disclosed herein permits the economical manufacture of a more wear-resistant earth-boring bit that is adapted to be manufactured by minimally skilled welders without the need for costly finish-grinding of teeth after hard-facing operations.

While the invention has been shown in only one of its preferred embodiments, it is thus not limited. It will be apparent to those having skill in the art that the present invention is subject to variation and modification without departure from the scope thereof.

We claim:

1. An improved earth-boring bit comprising:

a bit body;

at least one cutter rotatably secured to the bit body, the cutter including a plurality of teeth formed integrally with the cutter and arranged in circumferential rows on the cutter, each tooth having an inner end, an outer end, a pair of flanks, and a crest substantially transversely connecting the ends and flanks;

the crest of at least one of the plurality of teeth in at least one row having a depression formed therein and extending from the outer end of the tooth to an intermediate point along the crest, a remainder of the crest defining a raised guide rib portion;

a wear-resistant material applied over at least the crest and a portion of the ends and flanks of the at least one of the plurality of teeth, wherein a thickness of the wear-resistant material over the depression is substantially greater than elsewhere on the at least one tooth.

2. The improved earth-boring bit according to claim 1 wherein the guide rib portion facilitates application of the wear-resistant material over the tooth.

3. The improved earth-boring bit according to claim 1 wherein the depression is substantially planar.

4. The improved earth-boring bit according to claim 1 wherein the thickness of the wear-resistant material over the depression is ⅛ inch.

5. The improved earth-boring bit according to claim 1 wherein each of the crests of the plurality of teeth is provided with the depression and the guide rib portion.

6. An improved earth-boring bit comprising:

a bit body;

at least one cutter rotatably secured to the bit body, the cutter including a plurality of teeth formed integrally with the cutter and arranged in circumferential rows on the cutter, each tooth having an inner end, an outer end, a pair of flanks, and a crest substantially transversely connecting the ends and flanks;

the crest of at least one of the plurality of teeth in at least one row having a substantially planar depression formed therein and extending from the outer end of the tooth to an intermediate point along the crest, a remainder of the crest defining a guide rib portion;

a wear-resistant material applied over at least the crest and a portion of the ends and flanks of the at least one of the plurality of teeth, wherein a thickness of the wear-resistant material over the planar depression is substantially two times greater than elsewhere on the at least one tooth to provide a more wear-resistant tooth.

7. The improved earth-boring bit according to claim 6 wherein the thickness of the wear-resistant material over the planar depression is ⅛ inch thick.

8. The improved earth-boring bit according to claim 6 wherein each of the crests of the plurality of teeth is provided with the substantially planar depression and guide rib portion.

9. The improved earth-boring bit according to claim 6 wherein the thickness of the wear-resistant material over the planar depression is substantially ⅛ inch.

10. An improved earth-boring bit comprising:

a bit body;

at least one cutter rotatably secured to the bit body, the cutter including a plurality of teeth integrally formed with the cutter and arranged in circumferential rows on the cutter, each tooth having an inner end, an outer end, a pair of flanks, and a crest substantially transversely connecting the ends and flanks;

the crests of each the plurality of teeth in at least one circumferential row having a substantially planar depression formed therein and extending from the outer end of the tooth to an intermediate point along the crest, a remainder of the crest defining a guide rib portion; and a wear-resistant material applied over at least the crest and a portion of the ends and flanks of each tooth, wherein a thickness of the wear-resistant material over the planar depression is substantially not less that ⅛ inch and the guide rib portion facilitates application of the wear-resistant material over the crest.

* * * * *